US005129425A

United States Patent [19]

Howarth et al.

[11] Patent Number: 5,129,425

[45] Date of Patent: Jul. 14, 1992

[54] VALVE CONTROL SYSTEM

[76] Inventors: Ronald F. Howarth, 11208 - 86th Avenue, Delta, British Columbia, Canada, V4C 2W9; Domenico Ciolfitto, 7935 Meadowood Drive, Burnaby, British Columbia, Canada, V5A 4C1

[21] Appl. No.: 513,938

[22] Filed: Apr. 24, 1990

[30] Foreign Application Priority Data

Jan. 26, 1990 [CA] Canada ..... 2008694

[51] Int. Cl.[5] ..... F15B 13/043

[52] U.S. Cl. ..... 137/625.64; 83/712; 91/461; 137/625.63; 137/625.66

[58] Field of Search ..... 137/625.6, 625.63, 625.64, 137/625.66; 83/712; 91/461

[56] References Cited

U.S. PATENT DOCUMENTS

| | | | |
|---|---|---|---|
| 359,303 | 3/1887 | Westinghouse | 91/461 |
| 3,315,702 | 4/1967 | Passaggio | 137/625.64 |
| 3,771,565 | 11/1973 | Padula | 137/625.64 |
| 4,371,178 | 2/1983 | Ott | 137/625.66 X |
| 4,543,875 | 10/1985 | Imhof | 137/625.64 X |
| 4,593,719 | 6/1986 | Leonard | 137/625.64 X |

OTHER PUBLICATIONS

Brochure entitled "Tridel-Hydraulic Control for Log Turners", distributed to the Industry by Tridel Equipment Ltd. (undated).

*Primary Examiner*—Gerald A. Michalsky
*Attorney, Agent, or Firm*—John Russell Uren

[57] ABSTRACT

A control system particularly for use for saw mill machinery utilizing large pneumatic actuators. A joystick provides an electrical control signal to a hydraulic proportional pilot valve which, in turn, hydraulically controls a valve body which controls the flow of air to the pneumatic actuator.

5 Claims, 3 Drawing Sheets

VALVE CONTROL SYSTEM

INTRODUCTION

This invention relates to a control system and, more particularly, to a control system for use in controlling pneumatic actuators.

BACKGROUND OF THE INVENTION

Actuators are used for many purposes in controlling machinery. For example, in sawmills actuators are used for bar turners and carriage loading arms to control the position of a log or cant on a carriage which will then transport the log to the headrig. Such actuators are generally controlled by a control valve which will provide movement to the piston in the actuator, the piston regulating the flow of air from the actuator for controlling the machinery.

Bar turners will generally include pull up and pull down air cylinders which are used to position the log on the carriage. The cylinders are operated by air passing through the actuator. By controlling the position of a piston within the actuator, the operator can control the bar turner which, in turn, will control the position of the log. The control of a log position is important for optimum lumber return during the cutting of the log.

The position of the piston in the actuator is generally controlled by a control valve, the control valve having a spool which moves and which is pneumatically connected to the actuator to control its piston. In one known design, a control system comprises a control valve having a spool which is movable responsive to a piston of a hydraulic cylinder which is moveable by a hydraulically operated pilot. The spool of the cylinder is mechanically connected to the spool of the control valve so that when the piston of the cylinder moves, the spool of the control valve will move with the result that the amount and pressure of air leaving the actuator can be controlled.

The control valve, in turn, is generally controlled by a slave cylinder or valve. The slave cylinder or valve is intended, by exerting influence over the position of the spool in the control valve, to precisely control the operation of the actuator. Thus, the operator, by operating the slave cylinder or valve, can exert control over the actuator and the machinery to which the actuator is connected.

Heretofore, the preferred medium for use in the slave cylinder, the control valve and the actuator has been steam. Steam does not have substantial compressibility and its pressure is relatively high. As such, the operator could develop a good "feel" for the operation of the actuator by operating the slave cylinder. Good feel to the operator is important to precisely control the position of the log or cant on the carriage, since the maximization of lumber from a log or cant is highly desirable in a sawmill operation and this maximization is, in turn, obtained at least in part by the position of the log on the carriage.

Steam, however, has disadvantages. Most importantly, it is expensive to generate and, in some sawmill operations because of their location or otherwise, steam may be difficult to generate, cost considerations aside.

One solution proposed to replace the steam system has been a system such as that aforementioned where the actuator was mechanically controlled by the control valve and the control valve, in turn, was controlled by hydraulic fluid leaving the pilot valve. The mechanical linkage used, however, was disadvantageous since a "lag" occurred between the time that the pilot was actuated and the time the actuator made its move responsive to the move of the spool in the pilot. In addition, the mechanical linkage inherently had tolerances which were relatively large. This resulted in the piston of the actuator being only generally positioned with the result that the output of the actuator piston could not be precisely controlled. This, of course, is disadvantageous as set forth above.

A further known technique was to use a control valve which controlled the actuator with air. This solution was found to be deficient because the feel of the device was relatively poor due to the compressibility of air and the fact that the actuator could not be precisely positioned.

SUMMARY OF THE INVENTION

According to one aspect of the invention, there is provided a control valve comprising a valve body having first and second hydraulic fluid inlet and outlet ports operable to receive hydraulic fluid from a pilot valve and to move the spool of said valve body, air inlet and outlet ports on said valve body, said air inlet and outlet ports being operable to receive air from an air supply and to discharge said air to a pneumatic cylinder under the control of said pilot valve.

According to a further aspect of the invention, there is provided a control valve comprising a housing, end caps closing each end of said housing, a spool within said housing, a piston between each of said main caps and said spool, each of said pistons being biased to remain in contact with said spool, hydraulic fluid inlet and outlet ports to allow the entry and egress of hydraulic fluid to control the movement of said pistons and said spool and means to proportionately allow the entry and egress of said hydraulic fluid.

According to yet a further aspect of the invention, there is provided a sleeve assembly comprising first and second sleeves, an interface between said first and second sleeves allowing said first and second sleeves to be removably connected and a seal mounted in said first and second sleeves adjacent said interface.

BRIEF DESCRIPTION OF THE SEVERAL VIEWS OF THE DRAWINGS

A specific embodiment of the invention will now be described, by way of example only, with the use of drawings in which.

DESCRIPTION OF SPECIFIC EMBODIMENT

Figure 1:
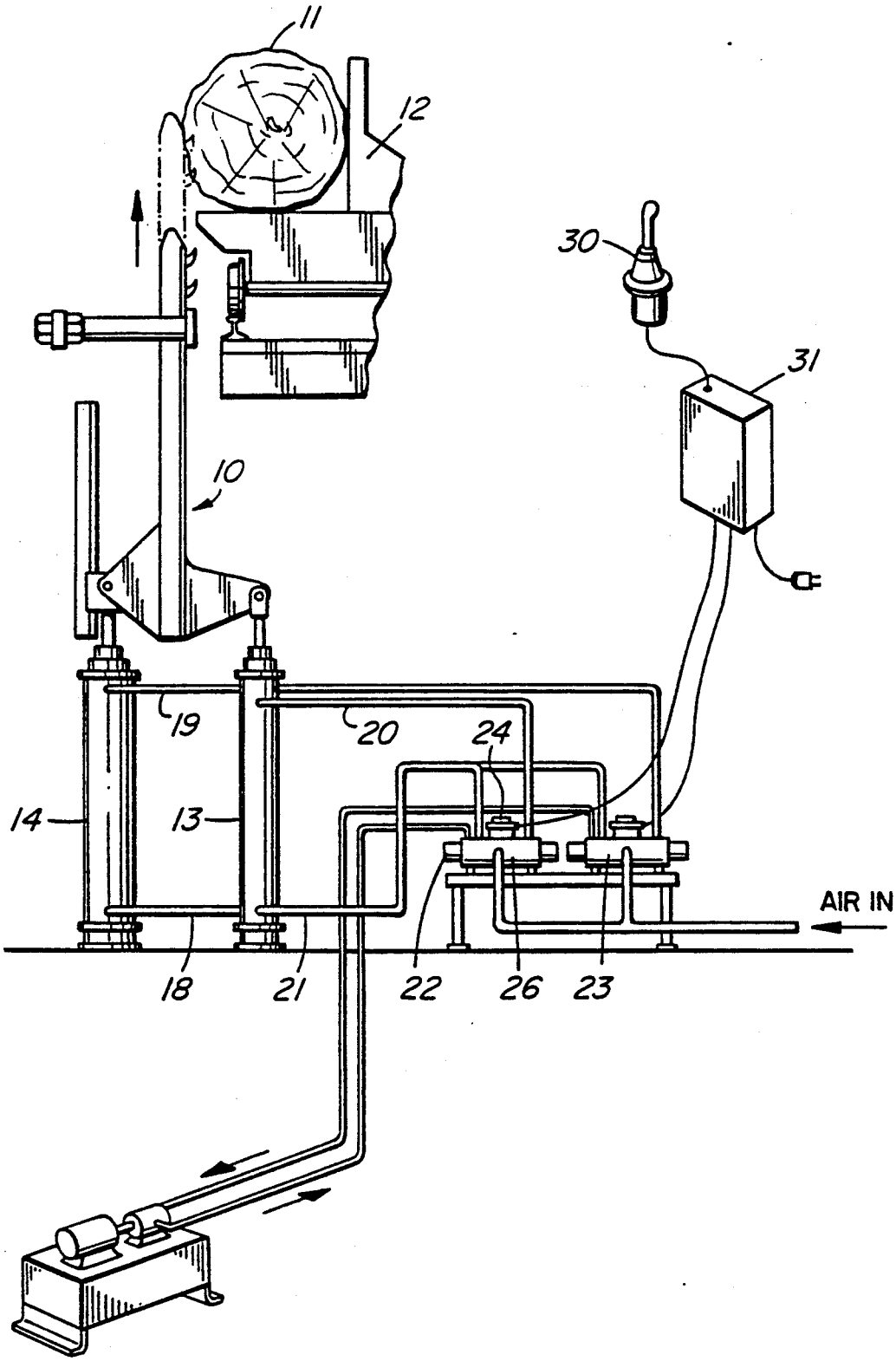
FIG. 1 is a diagrammatic view of a bar turner operated by two pneumatic cylinders or actuators, each actuator being controlled by a control valve according to the invention.

With reference now to the drawings, a bar turner generally illustrated at 10 in FIG. 1 is used to adjust a log illustrated diagrammatically at 11 on a carriage generally illustrated at 12 which is used to guide the log 11 to the headrig (not shown).

The bar turner 10 is moved with the use of a push-pull cylindrical arrangement, namely pneumatic actuators 13, 14 which extend and retract under the influence of pneumatic control lines 18, 19, 20, 21 extending between each actuator 13, 14 and its respective control valve illustrated generally at 22, 23. Since each control valve 22, 23 is operated and configured identically, only one control valve 22 will be described in detail, namely that control valve 22 controlling actuator 13.

Figure 2:
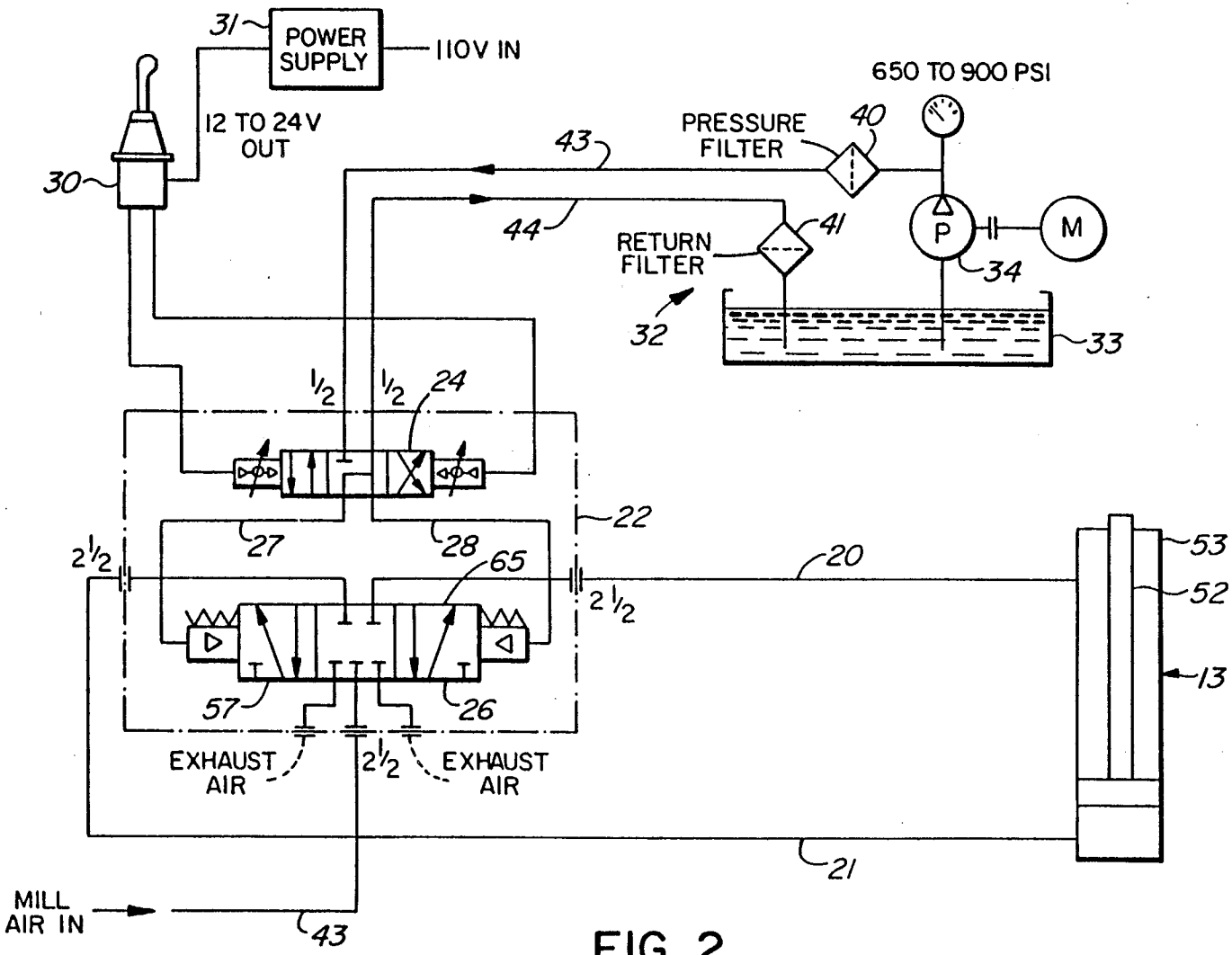
FIG. 2 is a schematic diagram of the system illustrated in FIG. 1.
Figure 3A:
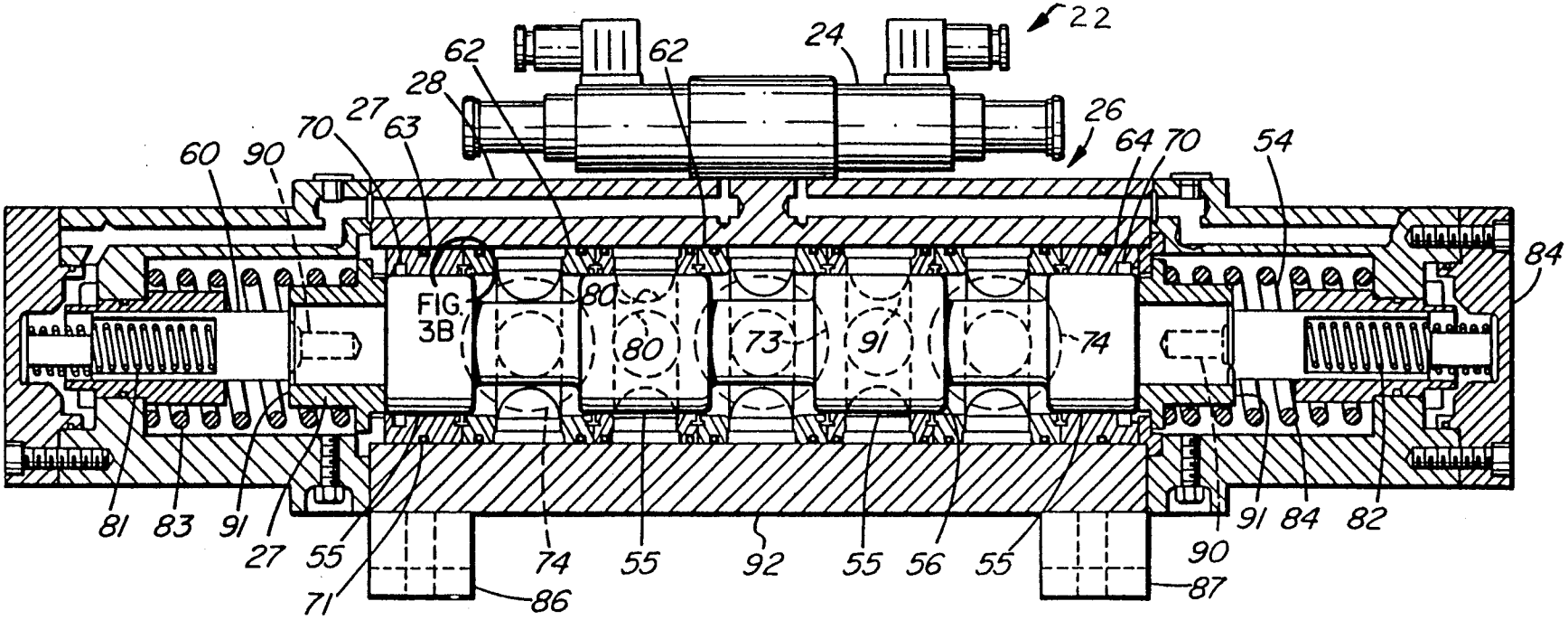
FIGS. 3A and 3B are a sectional view of the control valve according to the invention and an enlarged view of area IIIA, respectively.

The control valve 22 is operated by way of a respective electrically operated pilot valve 24 (FIGS. 2 and 3A). The pilot valve 24 controls the quantity and direction of hydraulic fluid passing from the pilot valve 24 to the main air valve or valve body 26.

The pilot valve 24 is electrically operated by an electronic joystick controller 30 (FIG. 2) which is under the control of an operator. A power source 31 is provided for the electrical operation of the joystick 30.

The actuator 13 is a pneumatic cylinder controlled by pneumatic air supply and discharge lines 20, 21, as set out herebefore which extend from the air control valve 22. Control valve 22 includes a ported 4-way, 3-position 2½" O-ring valve body 26 as also seen in FIGS. 2 and 3A and a hydraulic proportional pilot valve 24. The spool 27 of the valve body 26 is shifted by means of pilot valve 24 which is mounted directly on the valve body 26 as clearly seen in FIGS. 1 and 3.

The joystick 30 is operator controlled as is usual in the art. A 110 volt power supply 31 provides power to the joystick 30 which, in turn, provides a variable voltage to the pilot valve 24 under the influence of the operator.

The hydraulic system is illustrated generally at 32 in FIG. 2. It includes a hydraulic reservoir 33, a pressure compensated piston pump 34, a pressure filter 40 and a return filter 41. An accumulator (not shown) is preferably mounted in operative relationship with the hydraulic system 22.

Hydraulic lines 43, 44 extend between the aforementioned hydraulic system 32 to the pilot valve 24 and, thereafter, from the pilot valve 24 to the valve body 26. The hydraulics provided to the valve body 26 control the position of the spool 27 of the valve body 26 under the influence of the pilot valve 24 as will be explained in detail hereafter.

An air supply 43 provides a source of air to the valve body 26 of the control valve 22 at approximately 100 p.s.i. Thereafter, the air exits the valve body 26 and travels to the actuator 13. An exhaust muffler (not illustrated) is preferably provided on the downstream pneumatic line 50 exiting the valve body 26.

The control valve generally shown at 22 in more detail in FIG. 3A includes the valve body generally shown at 26 with the pilot valve 24 attached directly to the valve body 26. A spool 27 is positioned within the housing 28 of the valve body 26 and reciprocates within the housing 28 and the sleeve assembly generally illustrated at 35 under the influence of the hydraulic fluid acting on the spring loaded steel pistons 54, 60 mounted on the right and left ends of the spool 27, respectively. Each end of the spool 27 has an insert in the form of a steel capscrew 90 which is threadedly engaged with the spool 27 and which extends slightly beyond each end face 91 of the spool 27 and which acts as a contact with pistons 54, 60. Thus, any wear problems which might otherwise occur between the pistons 54, 60 and the spool 27 because of different materials used are minimized. The spool 27 has four (4) lands 55, each with radii, one radius of which is typical and shown at 56. The radii offer smooth movement of the spool 27 within sleeve assembly 35.

Figure 3B:
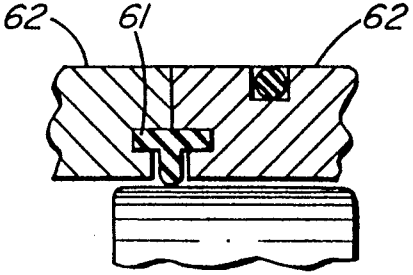

The sleeve assembly 35 is constructed from a plurality of individual spool sleeves 62 made from aluminum which are joined together in a unique manner and which is symmetrical about its central plane 92. Reference is made to FIG. 3B where a T-seal 61 is illustrated between two spool sleeves 62 which is typical. The T-seal 61 extends around the periphery of a complementary recess machined in each of the spool sleeves 62 and a clearance is provided between the spool sleeves 62 and the spool 27 as illustrated in FIG. 3B. This allows the spool 27 to ride on the T-seals 61 to allow a "floating" spool 27. Thus the sleeve assembly 35 may be easily disassembled if necessary. The sleeves 62 lock the T-seal 61 in place and prevent the seal 61 from rolling or blowing out.

The sleeve assembly 35 also comprises two outside spool sleeves 63, 64 positioned on the left and right ends of the sleeve assembly 35, respectively and five inside spool sleeves 62. The plurality of inside spool sleeves 62 are positioned between the outside spool sleeves 63, 64. Each of the five inside spool sleeves 62 have holes or slots 80 formed therein to allow the passage of air entering the valve body 26 from the pneumatic lines. Ribs 92 are positioned between the holes and slots 80 for strengthening purposes. A retaining ring 66 on each end of the sleeve assembly 35 holds the sleeve assembly 35 in its assembled position within the valve body 26.

The outside spool sleeves 63, 64 each have a wiper ring 70 mounted around the inside periphery and exerting pressure against the spool 27. An O-ring 71 is mounted about the outside periphery of each outside spool sleeve 63, 64 and on each end of the main spool sleeves 62. The five (5) main spool sleeves 62 are symmetrical about the center of the sleeve, the center main inside spool 62 being identical to the two outer main spools and the remaining main spools being identical and positioned between the center and outer main sleeve spools.

A pressure port 73 is machined in the housing 28 of the valve body 26. Two exhaust ports 74 are located on opposite sides of the pressure port 73. Each port has a diameter of 2½ inches for large air supply requirements but this size, of course, could be decreased or increased depending on the specific application.

The main spool pistons 54, 60 are spring biased as illustrated. Springs 81, 82 act to maintain contact between the main spool pistons 54, 60 and the spool 27 on each end. A pair of main spool compression springs 83, 84 act on the spool 27 and bias the spool 27 towards its neutral position as shown. End caps 83, 84 are mounted to the housing 28 with cap screws 85. A pair of mounting feet 86, 87 extend from the housing 28 and allow the valve body 26 to be positioned where desired.

OPERATION

In operation, it will be assumed the actuator 13 will be moved so that the position of a log 11 on the carriage 12 may be precisely controlled.

The operator will move the joystick 30 as is known and, in so doing, the joystick 30 will provide an appropriate electrical signal to the pilot valve 24. The electrical signal will move the spool of the pilot valve 24 into one of its three positions as illustrated in FIG. 2. As a result, hydraulic fluid provided to the pilot valve 24 from the hydraulic system 32 along lines 43, 44 will flow through the pilot valve 24 to the valve body 26 along lines 27, 28 as desired by the operator.

If it is assumed that it is desired to extend the piston 52 (FIG. 2) within the cylinder 53 of actuator 13, the spool 27 of the valve body 26 will assume the configuration with the leftmost area 37 of the spool of valve body 26 providing throughput from the air supply 43. Hydraulic fluid will exit the pilot valve 24 along line 27 and force the spool 27 of the valve body 26 rightwardly under the influence of piston 60 acting on the spool 27. The piston 52 of the actuator 13 will then extend the desired amount.

If it is desired to retract the piston 52 of actuator 13, pilot valve 24 will be operated such that hydraulic fluid exits line 28 to the main air valve 26 which will move the spool 27 leftwardly until area 65 allows air to exit the control valve 26 along line 20 to the actuator 13. Thus, the desired position of the actuator 13 may be obtained and, concomitantly, the position of the bar turner 10 and the log 11 on carriage 12.

With the spool of the pilot valve 24 in such a configuration, hydraulic fluid will flow through the pilot valve 24 and into the left hand control area of the valve body 26 thereby moving the spool to the right. The air will flow through the valve body 26 into the actuator 13 as indicated thereby extending piston 52. Piston 52, as earlier described, is connected to the bar turner 10 (FIG. 1) and is then used to manipulate the log.

The operation of the joystick 30 continues to provide appropriate electrical signals or voltage control to move the spool of the pilot valve 24 to a position appropriate to move the piston 52 of the actuator 13 and to thereby control the position of the bar turner 10. The joystick 30 is used to control the control valve 22 and the control valve 23.

Many further uses could be made for the control valve according to the invention. For example, the control valve is not necessarily confined to bar turners or even saw mill machinery. Rather, it could be used where such control is needed and, in particular, where such control is needed for large pneumatic cylinders.

The pilot valve 24 may be connected directly to the valve body 26 such as is illustrated in FIG. 3A. This provides compact configuration with the joystick 30 being located remotely from the control valve 22 and the hydraulic passages being located close to the main air valve 26.

Many modifications will readily occur to those skilled in the art to which the invention relates and the specific embodiment described herein should be considered as illustrative of the invention only and not as limiting its scope as defined in accordance with the accompanying claims.

What is claimed is:

1. A control valve comprising a hydraulic proportional electrically operated pilot valve operably connected to a main air valve, hydraulic fluid inlet and outlet ports in said pilot valve, a first set of said ports running to a hydraulic fluid reservoir and a hydraulic pump operable to provide hydraulic fluid from said reservoir under pressure to said pilot valve, a second set of said ports being connected and providing hydraulic fluid to said main air valve, said main air valve having a first set of ports running to said pilot valve, said main air valve further including a spool, centering springs to hold said spool in a neutral position, said spool being movable by said hydraulic fluid provided from said second set of ports of said pilot valve and an air supply operably connected to said main air valve for discharge from said air valve to a pneumatic cylinder, said air supply being discharged from said air valve and provided to said pneumatic cylinder being determined by the movement of said spool in said air valve from said neutral position.

2. A control valve as in claim 1 wherein said main air valve further comprises a housing, end caps closing each end of said housing, a spool within said housing, a piston between each of said end caps and said spool, each of said pistons being biased to remain in contact with said spool throughout the movement of said spool, said first set of ports of said air valve allowing the entry and egress of hydraulic fluid from said pilot valve to control the movement of said pistons and said spool.

3. A control valve as in claim 2 wherein said spool of said main air valve moves within a sleeve assembly, said sleeve assembly comprising first and second sleeves, an interface between said first and second sleeves allowing said first and second sleeves to be removably connected and a seal mounted between said first and second sleeves adjacent said interface.

4. A control valve as in claim 3 wherein said seal is a T-seal and a recess complementary to said T-seal is formed in each of said first and second sleeves.

5. A control valve as in claim 4 wherein said T-seal protrudes inwardly from the inside face of said first and second sleeves.

* * * * *